United States Patent [19]

Gerding

[11] 4,200,499

[45] Apr. 29, 1980

[54] WARP-RESISTANT DOORJAMB FOR A COKE OVEN

[75] Inventor: Charles C. Gerding, Pittsburgh, Pa.

[73] Assignee: Jones & Laughlin Steel Corporation, Pittsburgh, Pa.

[21] Appl. No.: 964,100

[22] Filed: Nov. 24, 1978

[51] Int. Cl.[2] ..... C10B 25/06

[52] U.S. Cl. ..... 202/248; 110/173 R

[58] Field of Search ..... 202/248; 110/173 R

[56] References Cited

U.S. PATENT DOCUMENTS

| | | | |
|---|---|---|---|
| 1,980,018 | 11/1934 | Van Ackeren | 202/248 |
| 2,025,967 | 12/1935 | Wilputte | 202/248 |
| 2,157,568 | 5/1939 | Potter | 202/248 |
| 2,658,865 | 11/1953 | Wolff | 202/248 X |
| 4,016,045 | 4/1977 | Van Ackeren | 202/242 |
| 4,060,459 | 11/1977 | Campana | 202/248 |
| 4,131,421 | 12/1978 | Abenderoth | 202/248 X |

*Primary Examiner*—Joseph Scovronek
*Assistant Examiner*—Roger F. Phillips
*Attorney, Agent, or Firm*—Thomas H. Murray; Clifford A. Poff

[57] ABSTRACT

A warp-resistant doorjamb is mounted next to the refractory at the outer end of a coke oven chamber. The doorjamb includes a rectangularly-shaped frame with end segments joining together two side segments each having a length substantially corresponding to the height of the coke oven chamber. Both side segments have an outwardly-extending rigid beam section with openings to releasably engage with hanger bars on a coke oven door. A plurality of web sections extends at spaced-apart intervals from each rigid beam section to define window openings between the web sections to minimize the conductive transfer of heat to the rigid beam section and dissipate heat to the atmosphere. A base plate section extends along the end and side segments and forms a face surface for mounting next to the refractory of a coke oven chamber. The base plate section is divided by transverse slots into individual base segments each joined with at least one of the web sections for the support thereby. Tube members divided by a longitudinal slot are inserted into the gap between the individual base segments to prevent escape of coke oven gas through the slot between the individual base segments. In one embodiment, a seal strip is attached at each side by welds to each base plate section. In a further embodiment, the web sections have slots to support the seal strip along one edge. Fasteners extend through enlarged openings in the seal strip into each base plate section.

11 Claims, 6 Drawing Figures

WARP-RESISTANT DOORJAMB FOR A COKE OVEN

BACKGROUND OF THE INVENTION

This invention relates to a jamb-like frame commonly referred to in the art as a doorjamb employed to provide a suitable seal surface and support for a coke oven door that forms a removable closure at the end of a coke oven chamber, and more particularly the present invention relates to such a doorjamb embodying a construction to provide the necessary stiffness to withstand a considerable bending moment without undue deflection arising out of the forces developed to support a coke oven door thereon as well as a construction to inhibit warping and distortion due to the high temperature environment to which the jamb is subjected when mounted for operation next to the refractory brickwork for a coke oven chamber.

In a battery of modern-day coke ovens, a frame conventionally identified as a doorjamb is mounted next to the refractory brickwork forming the coke oven chambers. A doorjamb is mounted in this manner at each end of every coke oven chamber in the coke oven battery for removably supporting a coke oven door. Because of the height of these chambers, usually about 14 feet, large forces are required to support and maintain a sealed relation with a coke oven door under particularly adverse conditions because of the highly-heated environment. A portion of the doorjamb is seated against the refractory of the coke oven chamber and the seated portion experiences the same temperature excursions as the refractory brickwork of the coke oven battery during the coking operation. Moreover, the doorjamb undergoes rapid quenching when, for example, a door fire is extinguished with water. A conventional doorjamb has a rather natural tendency to bow along its vertical height when the jamb is initially put into use on a coke oven chamber since the part of the doorjamb touching the refractory undergoes heating to a much higher temperature than the remaining part of the doorjamb. The temperature differential between the outer and inner regions of the jamb creates a concave bow or a bent-shape to the jamb. This thermally-responsive condition is essentially reversible since, in most instances, when the jamb is removed from the refractory brickwork, the thermally-responsive forces creating the distortion are dissipated and the frame resorts to its original shape. As a general proposition, the amount of a thermally-induced bow to a doorjamb varies with the mean slope of the temperature distribution across the jamb in cross section. The temperature distribution varies with the depth to which the jamb penetrates into the slot-like opening in the refractory brick of the furnace as well as the material used to form the jamb. Because most doorjambs have a T-shaped cross section, a temperature gradient exists across the head of the jamb which is in contact with the refractory brickwork and a different temperature gradient exists across the central section to the T-shaped configuration because the projected section is located outwardly of the refractory brickwork. A temperature gradient of 40° is typical across the head section of the jamb which is in contact with the refractory brickwork. This temperature gradient contributes to the well-known deflecting phenomenon known as hourglassing. The temperature gradient across the web section between the head and the free end thereof is typically on the order of 150° F. causing a bow-like warping to the jamb in the direction of its vertically-extended height. It is to be understood, of course, that the temperature gradients discussed above are greatly exceeded under extreme service conditions. Normally, if a linear temperature distribution exists across both the head section and the web section to the T-shaped configuration of a doorjamb, no stresses in the vertical side rails result from the bowing of an unrestrained jamb. Assuming a constant coefficient of thermal expansion, the amount of expansion at each temperature level is proportional to the temperature. However, if there is a substantial variation from a straight-line temperature distribution, then stresses will be induced which can be of substantial magnitude. Non-linear temperature distribution across the cross-sectional shape of a doorjamb occurs from transient heating effects, for example, due to a sudden heating of a portion of a jamb or from a steady-state condition involving irregular geometry to the cross-sectional shape of the jamb. Generally, a non-linear temperature distribution along a given cross section of a doorjamb causes stresses in the longitudinal direction of the side rails or vertical sides of the jamb. Design criteria for a doorjamb demand consideration of the development of stresses which result in short or long-term yielding of the jamb material. Even low thermal stresses will cause yielding, especially over a long period of time. Stresses due to an externally-applied load on highly-heated material result in yielding of the jamb material.

The thermal conditions adversely affecting a doorjamb cause both bowing and hourglass warpage conditions. Simple jamb bows of up to ¾ inch are commonly encountered on newly-installed jambs that are 14 feet in height. This bowing occurs as a curvature to the jamb into or out of the vertical plane of the oven due to the thermal or mechanical forces. Usually, however, bowing is due to a temperature differential across the cross section of the jamb. The usual door seal strip cannot mate with a jamb surface to provide adequate sealing when the jamb has a large bow or varying curvature.

Moreover, hourglassing which is a tendency for the long sides of the jamb to deflect toward each other due to the temperature differential impedes the placement of a coke oven door because of interference with the deflected portion of the doorjamb. The jamb seal surface will not align with the door seal strip. Both of these warped conditions of a doorjamb can bring about the unacceptable emissions of smoke and coke oven gas into the atmosphere.

SUMMARY OF THE INVENTION

It is an object of the present invention to provide a warp-resistant doorjamb apparatus embodying a design to minimize bowing in the direction of the coke oven chamber as well as hourglass-type deformations due to a temperature differential within tolerance levels that consistently permit the maintenance of a suitable seal surface for cooperative engagement with a seal member on a door for a coke oven chamber throughout extended periods of operation without failure due to creep or growth of the doorjamb.

It is a further object of the present invention to provide a warp-resistant doorjamb embodying a design wherein expansion slots are employed in the jamb portion subjected to the highest temperatures and a main strengthening section contributing the maximum strength to the jamb to withstand the necessary forces developed for maintaining a sealed relation with a removable coke oven door.

It is another object of the present invention to provide a warp-resistant doorjamb wherein the longitudinal portions of the jamb that extend vertically along the extended height of an oven chamber include rigid beam sections connected by heat dissipating web sections with window openings therebetween to minimize conductive transfer of heat to the beam section and a base section divided into segments by longitudinal slots for mounting next to the refractory of the coke oven chamber such that each base segment is joined by one or more web sections to the beam section and at the same time carries a seal strip.

More particularly, according to the present invention, there is provided a warp-resistant doorjamb apparatus for mounting next to the refractory at the outer end of a coke oven chamber to form a suitable closure with a removable coke oven door around the periphery thereof, the warp-resistant doorjamb apparatus including a rectangularly-shaped frame having two side segments joined together in a spaced-apart relation by end segments, each side segment having a length substantially corresponding to the height of a coke oven chamber and essentially including an outwardly-extending rigid beam section having means to releasably engage with a coke oven door for support thereof, web sections extending at spaced-apart intervals from the rigid beam section defining window openings between each web section to minimize the conductive transfer of heat to the rigid beam section and dissipate heat to the atmosphere, a base plate section extending along the end segments and the side segments to lie within a single plane forming a face surface for mounting next to the refractory of the coke oven chamber, the base plate section being divided by transverse slots into individual base segments each joined with at least one, and at most two, of the web sections for support thereby, means extending within each slot between adjacent ones of the individual base segments to prevent the flow of coke oven gas through the slot, and a seal means attached to the base plate section along the side thereof opposite the face surface to define a seal surface for cooperative engagement with a removable coke oven door.

In the preferred form of the present invention, the aforesaid seal means includes a plate member attached to each of the individual base plate segments by welds or the like. The means within each slot between the individual base segments preferably takes the form of a resilient seal such as a tube having a longitudinal slot in the side wall thereof and mounted within an annular opening extending between the seal strip and the face of the base segments which are mounted next to the refractory of the coke oven. It is preferred to construct the web sections with a generally rectangular cross section and angled in an upward direction toward the usual buckstays for supporting the refractory of the coke oven chamber. The web sections are arranged so that each longitudinal side forms an acute angle with a plane extending along the slot dividing the base section into individual sgements.

These features and advantages of the present invention as well as others will be more fully understood when the following description is read in light of the accompanying drawings, in which.

Figure 1:
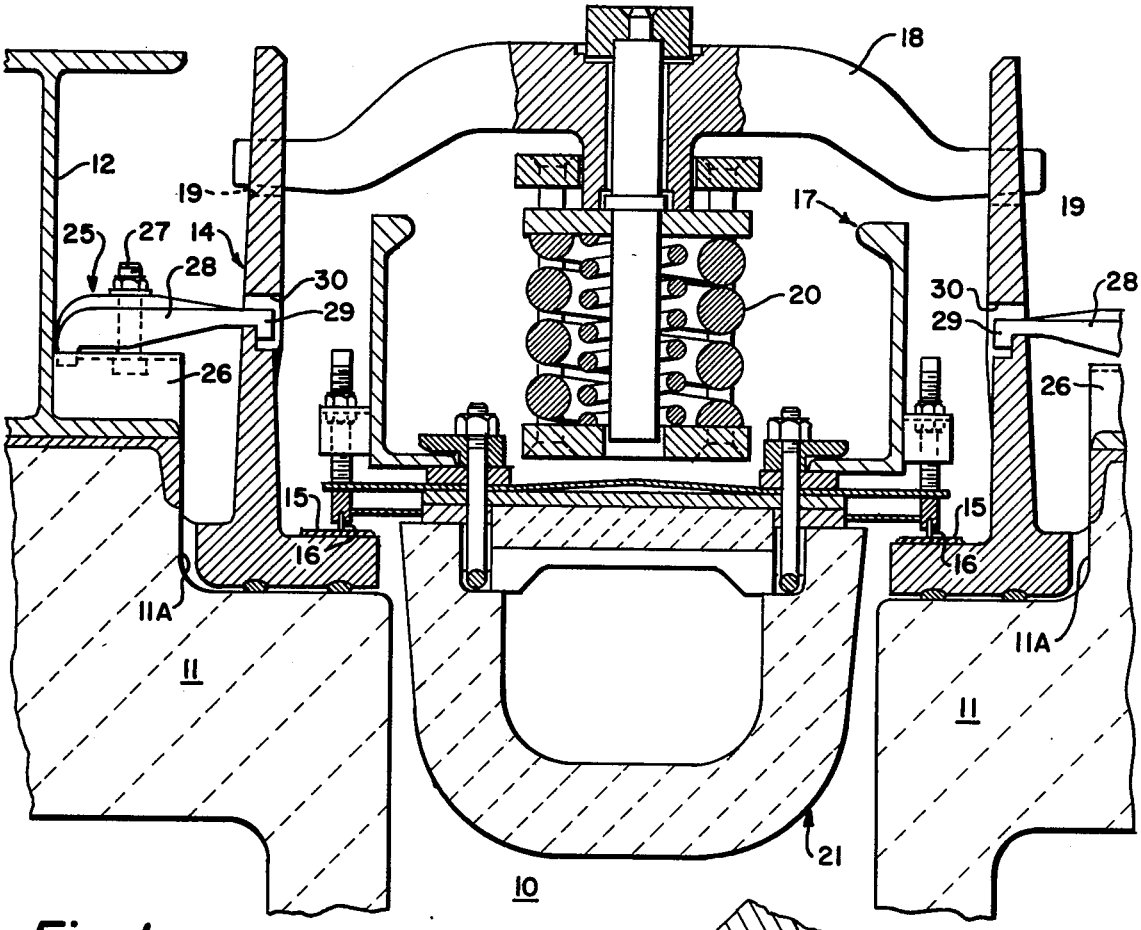
FIG. 1 is a partial sectional view taken at the machine side of a coke oven chamber illustrating a coke oven door in cooperation with a warp-resistant doorjamb of the present invention.

In FIG. 1, reference numeral 10 denotes a horizontal coke oven chamber in a recovery-type coke oven battery. Refractory bricks form vertical heating walls 11 that are supported by the usual buckstays 12 extending vertically along other vertical surfaces at each side of the oven chamber. A recess 11A is formed in the refractory brickwork along the outer face surface at the end of the coke oven chamber. A warp-resistant doorjamb 14 embodies a construction and assembly of parts according to the present invention for mounting next to the refractory brick within recess 11A. Suitable refractory material is used between the doorjamb and the refractory material to assure a gas-tight mounting therebetween. As will be described in greater detail hereinafter, the doorjamb defines a flat, outwardly-facing seal surface 15 that is engaged by an edge seal 16 adjustably carried on the frame of a coke oven door 17. At each of the top and bottom portions of the coke oven door, there is provided a locking bar assembly 18 that includes bars projecting outwardly from the door frame to engage within openings 19 (best shown in FIGS. 1 and 2) for the support of the coke oven door under a considerable force developed by springs 20 that are part of the coke oven door. One form of a coke oven door includes a refractory plug assembly 21 that is constructed in accordance with the teachings of copending application Ser. No. 966848, filed Dec. 5, 1978 and assigned to the same Assignee as this application.

Figure 3:
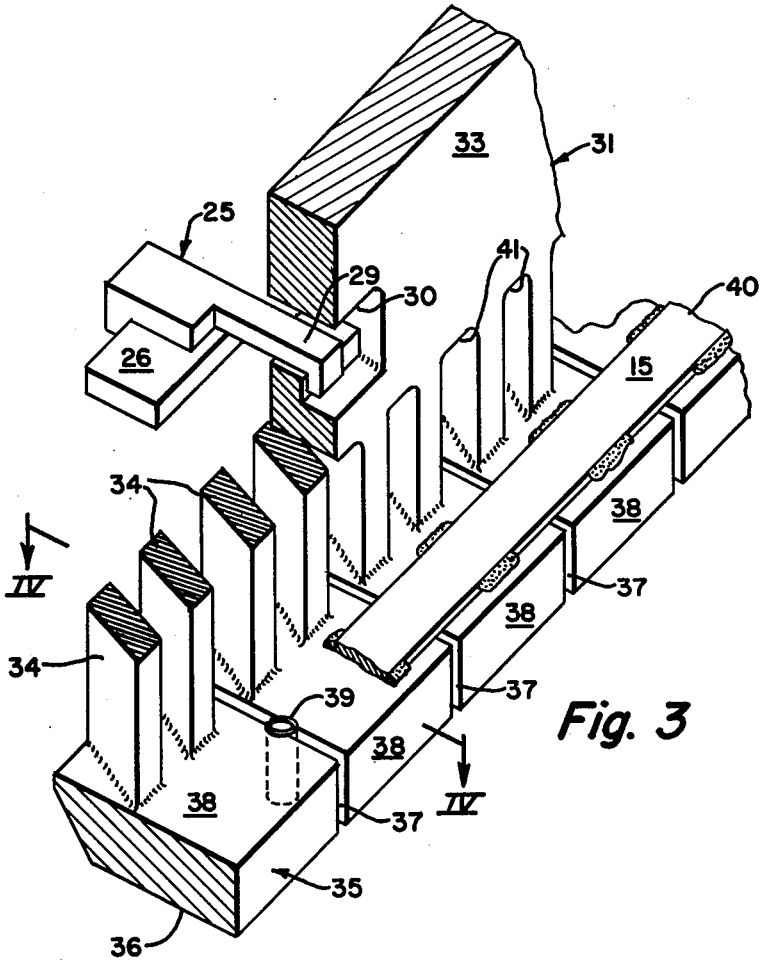
FIG. 3 is a perspective view of a vertical side rail illustrating the essential component parts of the warp-resistant doorjamb according to one embodiment.

The doorjamb apparatus of the present invention is retained against the refractory brickwork by clamp assemblies 25 arranged at spaced-apart locations along the vertical sides of the doorjamb. Each clamp assembly 25 includes a base member 26 attached for support to buckstays 12. The base member carries the head portion of a threaded bolt 27 passed through an opening in a lever 28. The lever 28 has a support surface at one end resting against the base 26 at a laterally-spaced location from an opening through which the threaded fastener 27 is passed. A nut and washer are passed onto the threaded end of the bolt 27 under a sufficient torque to impose a force upon the outwardly-extending end 29 which projects into and engages a face surface of a slot-like opening 30 provided in the doorjamb apparatus. It is to be understood that, if desired, a compression spring assembly may be interposed between the nut and the lever 28 to impose a resilient force on the lever to thereby prevent extreme mechanical forces from distorting the doorjamb apparatus. As best shown in FIG. 3, one or more of the levers located in the central portion of the doorjamb have a recess in the projected end portion to pass into a correspondingly-shaped recess formed in the opening 30 provided in the doorjamb. This relationship of parts is particularly useful to retain the doorjamb at its desired location and provides the necessary support to prevent hourglass-type distortion.

Figure 2:
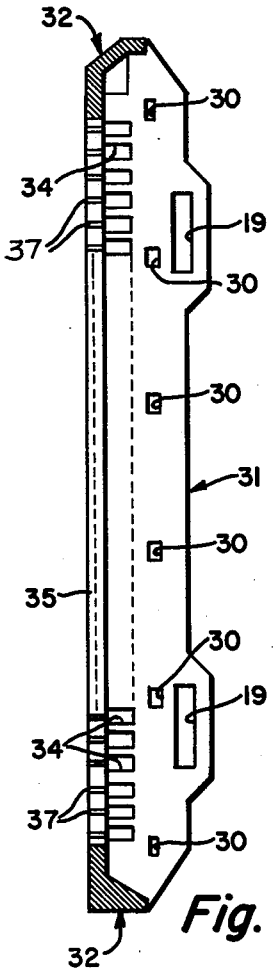
FIG. 2 is a longitudinal view, in section, of the warp-resistant doorjamb shown in FIG. 1.

Turning, now, to FIGS. 2–5, the jamb apparatus of the present invention preferably includes a unitary casting essentially defining three component parts. It is to be understood, of course, that a jamb apparatus embodying the features of the present invention may, if desired, be fabricated as a weldment. The jamb apparatus has an overall rectangularly-shaped configuration with an internal rectangularly-shaped opening corresponding essentially to the rectangular shape, in cross section, of the coke oven chamber. The rectangular shape of the frame is defined by two side segments 31 interconnected in a spaced-apart relation by end segments 32. Each side segment 31 has a length substantially corresponding to the height of the coke oven chamber. As shown in FIG. 2, the end segments 32 are of a rigid cross-sectional shape essentially in the form of an L-shaped beam section. Because the length of the end segments is very small in relation to the length of the side segments 31, distortion to the end segments is not material. Each side segment 31 essentially includes an outwardly-extending rigid beam section 33 that provides the necessary strength. The beam section includes the openings 19 for engaging the annular arms 18 as well as openings 30 for clamp assemblies 25 to support the jamb against the refractory brick of the coke oven chamber. A plurality of web sections 34 are each rectangularly-shaped with uniformly dimensioned cross-sectional area. The web sections are approximately uniformly spaced apart and extend in the direction toward the refractory brickwork of the coke oven chamber. The web sections extend to a base plate section 35 and joined thereto as an integral part. The base plate section extends along each of the side segments 31 as well as the end segments 32. The base plate section 35 forms a face surface 36 lying within a single plane and mounted next to the refractory of the coke oven chamber.

Figure 4:
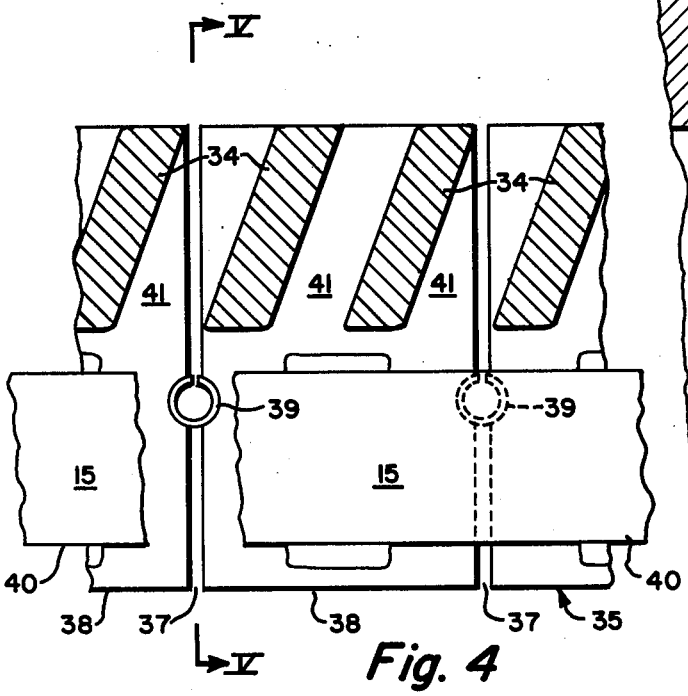
FIG. 4 is a sectional view taken along line IV—IV of FIG. 3.
Figure 5:
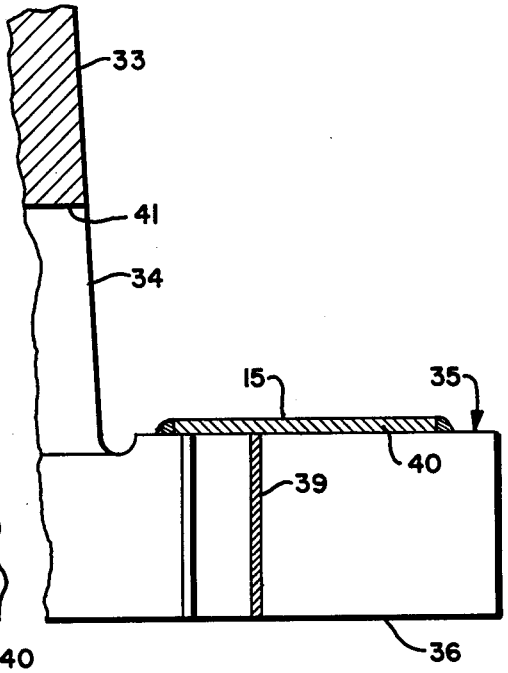
FIG. 5 is a section view taken along line V—V of FIG. 4.

According to the present invention, the length of the base plate section 35 which coextends with the side segments 31 is divided by transverse slots 37 into individual base segments 38. Each base plate segment 38 is joined with one but preferably, as shown in FIGS. 3 and 4, two web sections 34. The slots 37 form expansion joints along the base sections. Interposed in each slot is a flexible seal member 39 to extend from a flush relation with the face surface 36 to the oppositely-disposed face surface of the base section. The flexible seal member 39 preferably takes the form of a tube that is divided along its length by a saw cut for expansion and contraction while located within a drilled hole that enlarges the slot and provides annular side walls for supporting the tube. The flexible seal members 39 prohibit the flow of coke oven gas through the slot that might otherwise occur since the slot communicates with a gap between the coke oven door and the refractory brickwork forming the oven chamber. In the embodiment shown in FIGS. 3–5, a relatively thin seal plate 40 is attached by small weld deposits at opposite sides thereof to each base segment 38 so that the seal plate extends in an overlying relation along exposed ends of the flexible seal member 39. The seal strip 40 defines the seal surface 15 described above for cooperative engagement with the knife-edge seal 16.

The web sections as described previously have a rectangular shape in cross section and extend in a spaced-apart relation. The construction of the web sections is such as to define window openings 41 between web sections to minimize the conductive transfer of heat to the rigid beam sections 33 through their inherent thermal resistance and through the dissipation of heat to the atmosphere. The window openings 41 are slightly larger in relation to the transverse dimension of the opening than the corresponding transverse dimension to the thickness of a web section. Moreover, to facilitate the transfer of heat to the atmosphere, the web sections are arranged in an angular relationship so that convectively-driven air currents along the doorjamb pass through the window opening and thence along the outer side of the doorjamb. The angularly-disposed relation of the web sections is clearly apparent from FIGS. 3 and 4 where the longitudinal side of each web section lies within a plane that forms an acute angle with a plane extending along the slot 37. The intersection of these two planes is at the side of the doorjamb directly toward the buckstays 12. Thus, the web sections are defined to extend in an upwardly-angled relation when the doorjamb is operatively seated against the refractory brickwork of the oven chamber. The overall cross-sectional shape of the doorjamb at the side portions 31 is that of an L-shaped configuration in which the superimposed relation of the web sections 34 with the beam section 33 forms one leg of the L-shape and the base plate section 35 extends at a generally right-angle relation.

Figure 6:
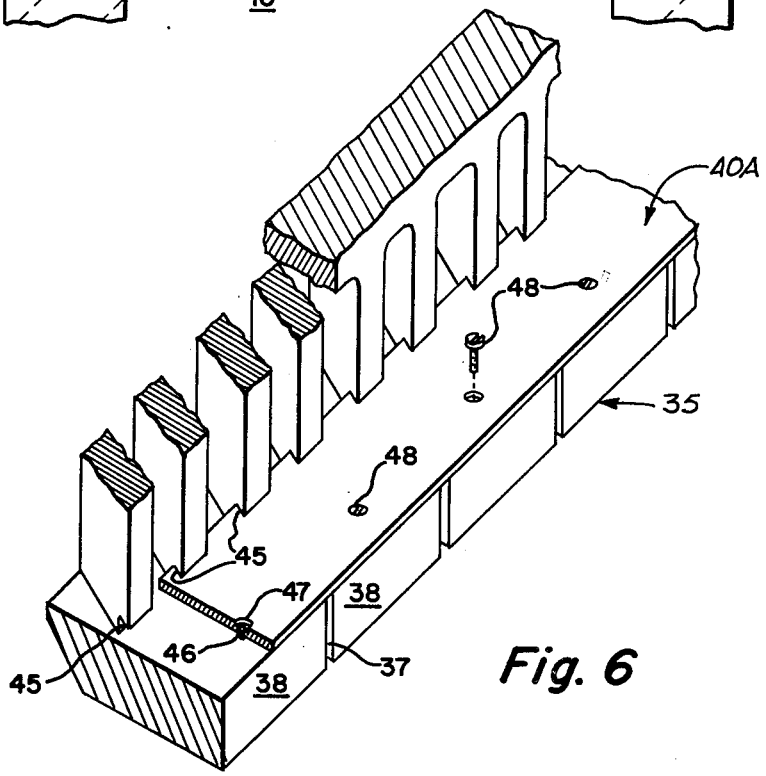
FIG. 6 is a perspective view of a vertical side rail illustrating the essential component parts of the warp-resistant doorjamb according to a second embodiment.

In FIG. 6, a further embodiment of the present invention is illustrated which differs from the preferred embodiment by the construction of parts to support the seal strip. Accordingly, the foregoing description applies with equal effect to the embodiment illustrated in FIG. 6 and the same reference numerals identify the same parts in both embodiments. In FIG. 6, the web sections 34 each further includes a slot 45 which is dimensioned and arranged to receive the edge of a seal strip 40A. The slots 45 are dimensioned and arranged to captively support one longitudinal edge of the seal strip. The seal strip is retained and further supported by fasteners 48 typically in the form of rivets or threaded bolts that are passed through openings 46 that extend along the outer marginal edge of the strip. The fasteners engage with suitable openings in each of the base segments 38. The head portion of the fasteners is recessed below the seal surface 15A by forming in the seal strip an enlarged counterbore 47. An adequately large amount of clearance is especially desirable between each fastener and the seal strip to accommodate thermal expansion and contraction to the seal strip. In this way, the seal strip is free for sliding movement along the base plate section 35. This construction of parts reduces the bending moment on the rigid beam section 33 to a negligible value due to seal strip expansion.

Although the invention has been shown in connection with certain specific embodiments, it will be readily apparent to those skilled in the art that various changes in form and arrangement of parts may be made to suit requirements without departing from the spirit and scope of the invention.

I claim as my invention:

1. A warp-resistant doorjamb apparatus for mounting next to the refractory at an outer end of a coke oven chamber to form a sealable closure with a removable coke oven door around the periphery thereof, said warp-resistant doorjamb apparatus including:

a rectangularly-shaped frame including at each vertical side an outwardly-extended rigid beam section having means to releasably engage with a coke oven door for support thereof, web sections extending at spaced-apart intervals from said rigid beam section defining window openings between each web section to minimize the conductive transfer of heat to the rigid beam section by their thermal resistance and through dissipation of heat to the atmosphere, a base plate section extending within a single plane to form a face surface for mounting next to the refractory of the coke oven chamber, a part of said base plate section being divided by transverse slots into individual base segments each joined with at least one of said web sections for support thereby, means extending within each slot between adjacent ones of said individual base segments to prevent the flow of coke oven gas through the slot, and seal means attached to said base plate section along the side thereof opposite said face surface to define a seal surface for cooperative engagement with a removable coke oven door.

2. The warp-resistant jamb apparatus according to claim 1 wherein said seal means includes a thin plate member centrally attached to each of said individual plate segments.

3. The warp-resistant jamb apparatus according to claim 1 wherein said means extending within each slot includes a resilient seal extending between said face surface of the base plate section and said seal means.

4. The warp-resistant jamb apparatus according to claim 3 wherein said resilient seal includes a tube having a longitudinal slot in the side wall thereof.

5. The warp-resistant jamb apparatus according to claim 1 wherein said web sections each has a rectangular cross section with the elongated side thereof lying in a plane forming an acute angle with a plane along the transverse slot dividing said base plate section into individual base segments.

6. The warp-resistant jamb apparatus according to claim 5 wherein the plane containing the elongated side of said web section intersects with the plane along the transverse slot at a point externally of said rectangularly-shaped frame.

7. The warp-resistant jamb apparatus according to claim 1 wherein the width of said window between said web sections is greater than the width of a web section.

8. The warp-resistant jamb apparatus according to claim 1 wherein each side of said frame has an L-shaped cross section with said base plate section extending transversely to a superimposed extended length of said web section and said rigid beam section.

9. The warp-resistant jamb apparatus according to claim 1 wherein two of said web sections interconnect each of said individual base segments with a rigid beam section.

10. The warp-resistant jamb apparatus according to claim 1 wherein said seal means includes a thick plate member slideably attached to said frame.

11. The warp-resistant jamb apparatus according to claim 1 wherein said web sections have openings to receive said seal means, and wherein said apparatus further comprises fasteners to retain said seal means on said base segments.

* * * * *